US005899619A

United States Patent [19]

O'Shei

[11] Patent Number: 5,899,619

[45] Date of Patent: May 4, 1999

[54] HAND HELD MARKING DEVICE

[75] Inventor: Thomas O'Shei, West Seneca, N.Y.

[73] Assignee: May O'Shei, West Seneca, N.Y.

[21] Appl. No.: 08/969,854

[22] Filed: Nov. 14, 1997

[51] Int. Cl.[6] ..... B43K 8/02

[52] U.S. Cl. ..... 401/35; 401/14; 401/193; 401/202; 401/207

[58] Field of Search ..... 401/14, 17, 35, 401/23, 193, 202, 207

[56] References Cited

U.S. PATENT DOCUMENTS

| | | | |
|---|---|---|---|
| D. 300,118 | 3/1989 | Venne et al. | 401/202 X |
| 336,612 | 2/1886 | Wittram | 401/23 |
| 1,020,221 | 3/1912 | Rauchenecker | 401/35 X |
| 2,554,335 | 5/1951 | Kollsman | 401/35 |

FOREIGN PATENT DOCUMENTS

| | | | |
|---|---|---|---|
| 960832 | 4/1950 | France | 401/35 |
| 971711 | 1/1951 | France | 401/35 |

*Primary Examiner*—Steven A. Bratlie
*Attorney, Agent, or Firm*—Hodgson, Russ, Andrews, Woods & Goodyear LLP

[57] ABSTRACT

A hand held marking device including two independent fluid reservoirs for holding liquids to be applied. The two independent refillable liquid reservoirs are in a back to back relationship with respect to one another.

10 Claims, 2 Drawing Sheets

FIG. 4
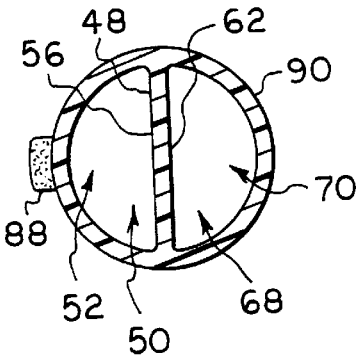
FIG. 5
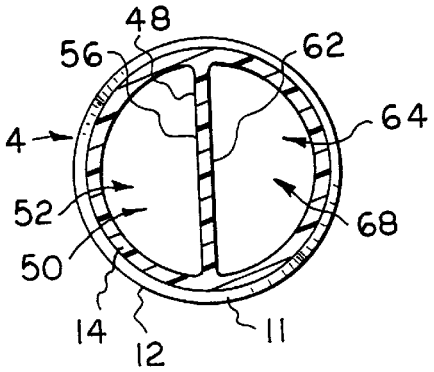
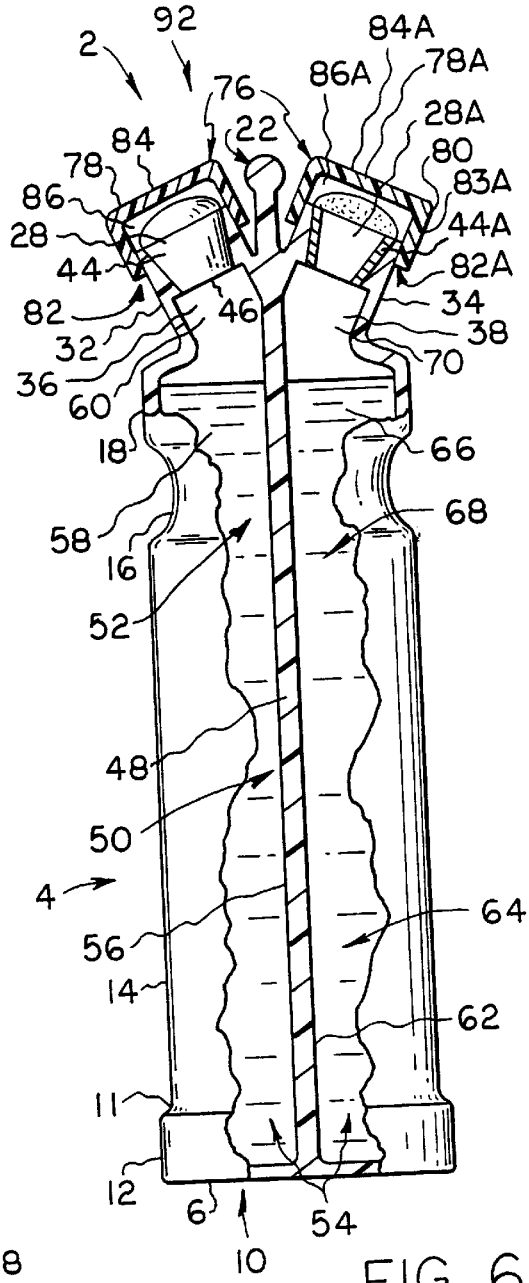
FIG. 6
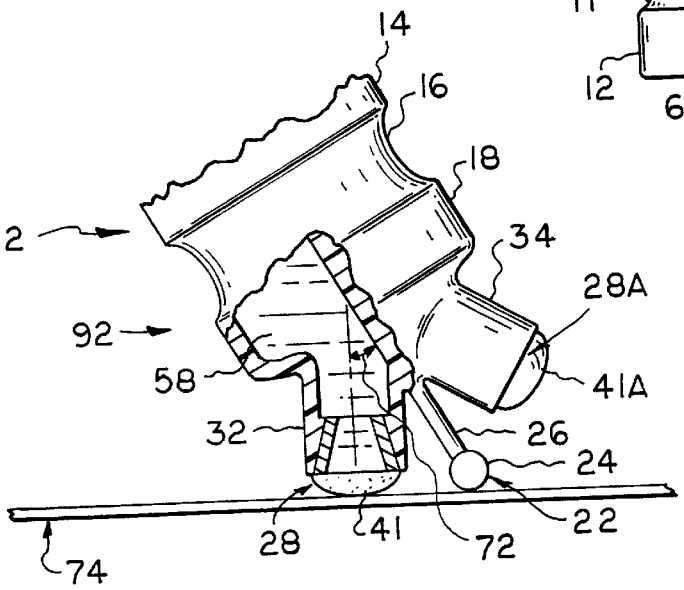
FIG. 7

HAND HELD MARKING DEVICE

BACKGROUND OF THE INVENTION

1. Field of the Invention

The present invention relates generally to devices for applying liquids, and more particularly, to hand held devices for applying and coating a surface with a liquid.

2. Prior Art

Presently, hand held markers are used to apply a liquid on a surface, and are then discarded when the supply of liquid is exhausted. Also, present markers have only one source of the liquid therein, which requires the use of numerous markers to provide for a variety of different colors.

Thus, there is presently a great need for a nondisposable hand held marking device which provides the user with a number of different liquid sources, and also permits the user to refill the marking devices whenever the liquid supply becomes exhausted.

SUMMARY OF THE INVENTION

It is an object of the present invention to provide a hand held marking device which has two separate liquid reservoirs and two separate depositing means for independently applying each of the liquids.

It is an object of the present invention to provide a hand held marking device in which the liquid reservoirs are independently refillable.

It is another objective of the present invention to provide a bumper to prevent the two separate depositing means from simultaneously contacting the surface to be coated.

It is an object of the present invention to provide a marking device which can be embodied in a variety of ergonomically advantageous shapes such that it comfortably fits the user's hand.

Various other objectives and advantages will appear from the following description of the several embodiments of the present invention, and the novel features will be particularly pointed out hereinafter in connection with the appended claims.

The present invention is a marker which has therein a first chamber and a second chamber, which are in a back to back relationship with one another and separated by a dividing wall. The chambers are for holding a first and second liquid, which can be ink, paint, glue and the like.

The marker has a top portion from which two portals extend. The first portal is in fluid communication with the first chamber and the second portal is in fluid communication with the second chamber. A means for depositing the liquid is manually releasably fitted within each portal means. The depositing means are for absorbing the liquid from the chambers and applying it on the surface to be coated. Caps are provided which cover the portals and prevent the drying out of the liquid in the chambers through the depositing means.

The marker has a bumper, extending from the top portion and located between each of the portals, which prevents both of the depositing means from simultaneously contacting the surface to be coated.

The depositing means are manually pressure fitted into the portals and manually removable by the user so that the first and second chambers can be refilled with the liquid as desired.

Several embodiments are provided, which have differently configured housings, resulting in a comfortably grippable marker which is ergonomically advantageous.

These and the other novel features and characteristics of the present invention will be apparent from the following detailed description, appended claims and drawings.

BRIEF DESCRIPTION OF THE DRAWINGS

In the appended drawings, shown therein is the following:

FIG. 4 shows a crossectional view of the embodiment of FIG. 1, taken along line 4—4;

FIG. 5 shows a crossectional view of the embodiment of FIG. 3 taken along line 5—5;

FIG. 6 shows a cut away view of the embodiment of the marker beans of FIG. 3;

FIG. 7 shows a cutaway view of the top portion of the marker means as it would appear when coating a surface with a liquid.

DETAILED DESCRIPTION OF THE PREFERRED EMBODIMENTS

Figure 1:
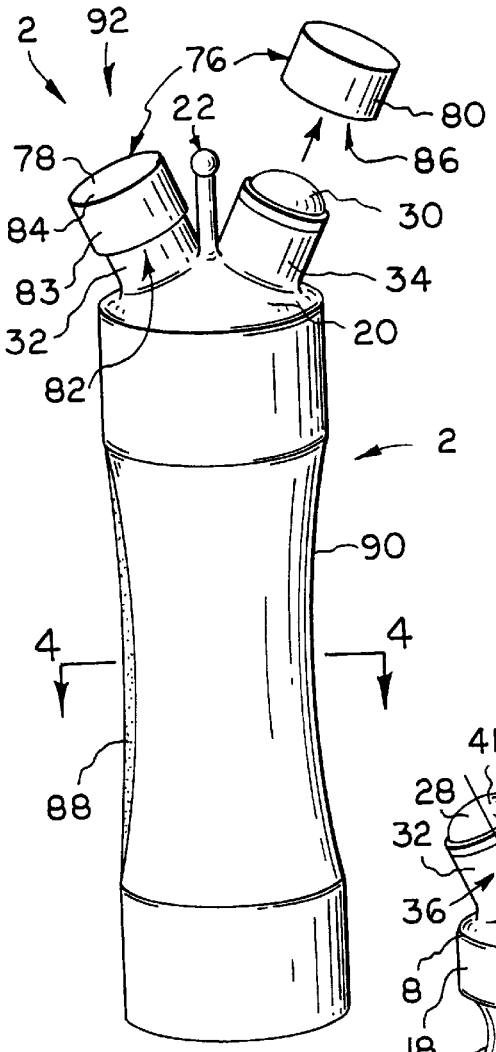
FIG. 1 shows a plan view of an embodiment of the marker means.
Figure 2:
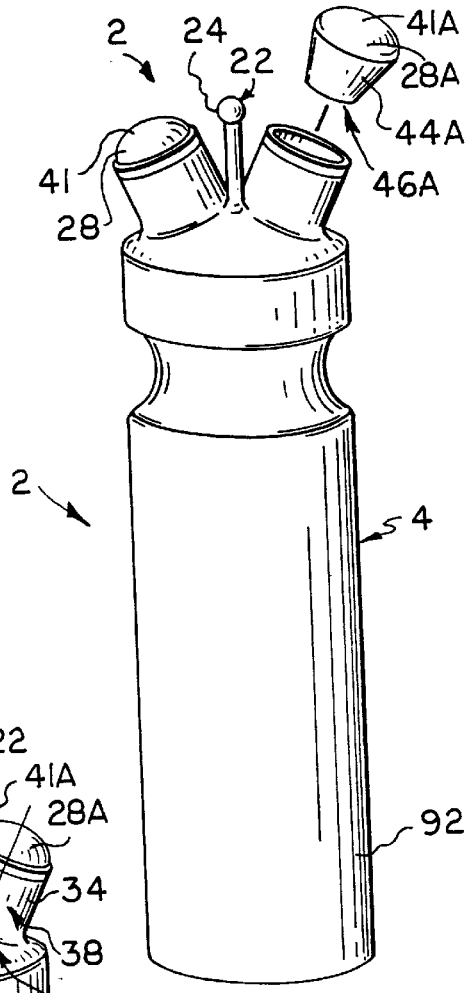
FIG. 2 shows a plan view of an embodiment of the marker mean.
Figure 3:
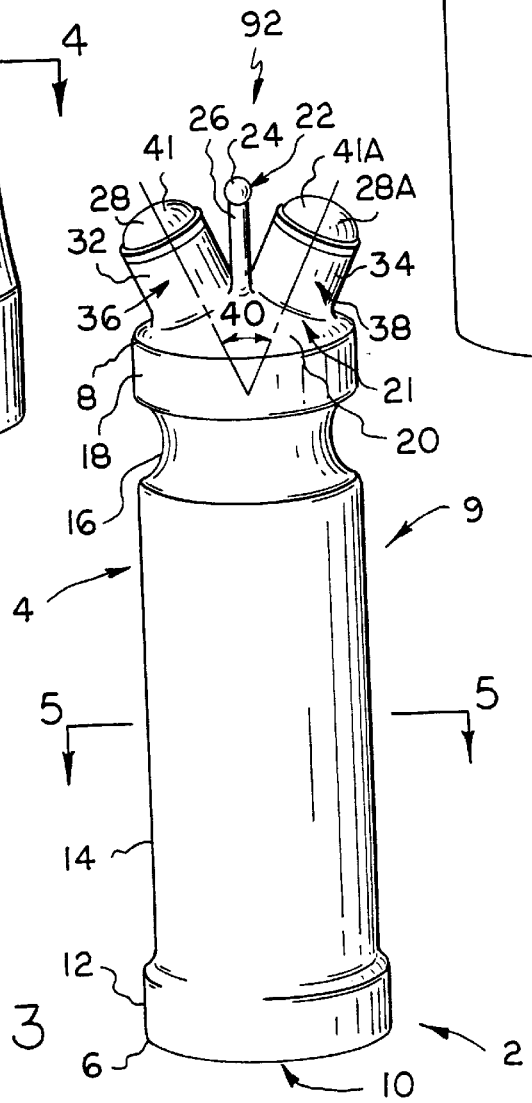
FIG. 3 shows a plan view of an embodiment of the marker means.

Turning now to FIGS. 1–3, shown therein are three illustrative embodiments of the present invention. The present invention includes a marker 2, fully described below, fabricated of thin pliable plastic, formed from blow molding or injection molding of thermo-plastics or resins, or formed by extrusion or pressure molding of thermosetting plastics or resins and the like. Marker 2 may also be constructed of more rigid materials, such as steel, aluminum, wood, and the like, the manner of working these materials well known to those or ordinary skill in the relevant art.

Turning now to FIG. 3, shown therein generally is marker 2. A housing 4, the portion of marker 2 which the user grips, is molded or otherwise fabricated to include a lower cylindrical region 12 which merges into an inwardly angled region 11. Inwardly angled region 11, in turn, merges into a middle cylindrical region 14. An inwardly curving gripping region 16 merges into middle cylindrical region 14 and an upper cylindrical region 18. At a bottom end 6 of housing 4, the marker 2 has a base 10 merged thereto, base 10 closes bottom end 6 of housing 4, and may be used for setting the marker means 2 on a surface 74, such that marker means 2 stands in an upright position 9 shown in the illustrative embodiment of FIG. 3.

Marker 2 also includes a top portion 20, which merges with the top end 8 of housing 4, top portion 20 includes a dome area 21. Top portion 20 also comprises a first portal 32 and a second portal 34 which extend outwardly from the dome area 21. First portal 32 and second portal 34 extend such that first portal 32 and second portal 34 define a portal angle designated numeral 40 therebetween, Top portion 20 also has a bumper 22 extending from the dome area 21, and positioned between first portal 32 and second portal 34. The bumper is formed to have a pressure portion 24 and an extension portion 26, the extension portion 26 elevates pressure portion 24 above first portal 32 and second portal 34, the utility of which is discussed fully below. Also, first portal 32 is formed to have a first throughbore 36 extending completely therethrough, and second portal 34 is formed so as to have a second throughbore 38 extending completely therethrough.

Turning now to the illustrative embodiment at FIG. 6, shown therein is a partial cutaway view of the embodiment illustrated in FIG. 3. Marker 2 has a dividing wall 48 formed and contained completely therein, separating a first chamber 50 which defines a first reservoir 52, from a second chamber 64 which defines a second reservoir 68. First chamber 50 and second chamber 64 are in a back to back type positional relationship with respect to one another, best shown in FIG. 6. Dividing wall 48 forms an impermeable seal between the first chamber 50 and the second chamber 64, and mergedly connects to the base 10, housing 4, and the dome area 21 of the top portion 20. Thus, first reservoir 52 is defined by the base 10, a first side 56 of the dividing wall 48, the housing 4, and the dome area 21. Similarly, second reservoir 68 is defined by base 10, a second side 62 of the dividing wall 48, housing 4, and the dome area 21. Turning now to FIG. 5, in the illustrative embodiment shown therein is a crossectional view of the marker 2 taken along line 5—5 of FIG. 3. FIG. 5 illustrates first chamber 50 separated from second chamber by the dividing wall 48, and also shows the housing 4.

Returning to FIG. 6, first reservoir 52 and second reservoir 68 are for holding liquids 54, and more particularly, first reservoir 52 is for holding a first liquid 58 and second reservoir 68 is for holding a second liquid 66. First liquid 58 and second liquid 66 may be inks of different colors, florescent inks, paints of different colors, glues, and other similar type liquids which are desirably applied to a surface 74, shown in FIG. 7. Returning to FIG. 6, a first air space 60 is illustrated above the first liquid 58 in the first reservoir 52, and a second air space 70 is illustrated above the second liquid 66 in the second reservoir 68. The size of the first air space 60 and the second air space 70 are, of course, directly proportional to the amount of first liquid 58 and second liquid 66 present.

The present invention allows the controllable application of first liquid 58 and second liquid 66 from marker 2 to surface 74, by use of a first means for depositing 28 and a second means for depositing 28A. The first means for depositing 28 and second means for depositing 28A may be identically formed and shaped, best illustrated in FIGS. 2 and 6. The first depositing means 28 and second depositing means 28A may be constructed of a rubber, sponge, or felt material which is capable of absorbing a liquid and becoming saturated with the liquid, yet not so porus as to permit the liquid to flow therethrough unabated, so as to have the ability to controllably release and apply a liquid to a surface 74. Further, the first depositing means 28 and second depositing means 28A may be fabricated or cut to a generally conical shape, best illustrated in FIG. 2, such that first depositing means 28 has a first contact surface 41 and second depositing means 28A has a second contact surface 41A. The remaining structure of the first depositing means 28, illustrated in FIG. 6, includes a surrounding conical surface 44, and an absorbing surface 46. Similarly, the second depositing means 28A includes a surrounding conical surface 44A and an absorbing surface 46A. First contact surface 41 and second contact surface 41A are for contacting the surface 74 illustrated in FIG. 7. Of course, the first depositing means 28 and second depositing means 28A may have shapes other than the conical shape described above, and these other shapes are also within the scope of the present invention.

First depositing means 28 and second depositing means 28A are releasably fittable within marker 2 as follows. Referring to FIGS. 3 and 6, the first portal 32 has first throughbore 36 extending completely therethrough, and second portal 34 has second throughbore 38 extending completely therethrough. The first depositing means 28 is releasably fittable into the first throughbore 36, and the second depositing means 28A is releasable fittable into the second throughbore 38. For example, first depositing means 28 is manually pressure fitted into first throughbore 36, such that its surrounding conical surface 44 frictionally engages first portal means 32, and its absorbing wall 46 is located within first chamber 50. First depositing means 28 can be likewise manually removed so that access to first chamber 50 is gained through first throughbore 36. First reservoir 52 can then be refilled with ink, glue, paint, and the like, and then first depositing means 28 can be manually reinserted into first throughbore 36 to seal the first chamber 50. Second depositing means 28A can be insertably removed in an identical manner in and out of the second throughbore 38, so that the surrounding conical surface 44A frictionally engages with the second portal 34, thus permitting access to second chamber 64 for refilling with liquid 66 and the like.

It is undesirable to leave the first depositing means 28 and the second depositing means 30 exposed to the atmosphere, designated 92, as evaporation would steal away the store of the first liquid 58 and the second liquid 66. Thus, as illustrated in the embodiments of FIGS. 1 and 6, the present invention provides closure means 76, removably attachable over the first portal 32 and second portal 34. Closure means 76 includes first cap 78 and an identically shaped second cap 78A, and the identically shaped first and second caps may be fabricated of thin pliable plastic, formed from blow molding or injection molding of thermoplastics or resins, or formed by extrusion or pressure molding of thermosetting plastics or resins and the like, and may be constructed of more rigid materials, such as steel, aluminum, wood, and the like, the manner of working these materials well known to those or ordinary skill in the relevant art. First cap 78 has an first open end 82 and a first closed end 84, with a first surrounding cap wall 83 nestled therebetween the first cap 78 defining a first receptacle 86 therein. Second cap 78A has second open end 82A and a second closed end 84A, with a second surrounding cap wall 83A nestled therebetween, the second cap 78A defining a second receptacle 86A therein. The first open end 82 and first receptacle 86, and second open end 82A and second receptacle 86A are sized so as to be manually pressure fittable over first portal 32 and second portal 34 respectively.

Turning now to FIG. 7, illustrated in the embodiment shown therein is the actual use of marker 2 on the surface 74. The surface 74 may be a bingo card, a painting, or any surface desired to be coated with first liquid 58 or second liquid 66. As illustrated, with first cap 78 removed, the first contact surface 41 of first depositing means 28 contacts the surface 74, while simultaneously the pressure portion 24 of bumper 22 contacts the surface 74. First contact surface 41, of course, applies the first liquid 58 to surface 74. The bumper 22 serves to prevent any portion of second depositing means 28A from contacting the surface 74, thus preventing any undesirable coating of the surface 74 with second liquid 66. A contact angle 72 is defined between the first portal 32 and the bumper 22. The user need only rotate marker 2 in order to apply the second liquid 66 through second depositing means 28A on the surface 74.

There are additional embodiments of the present invention illustrated in FIGS. 1 and 2, which provide for ergonomically advantageous shapes of housing 4, such that marker 2 comfortably fits within the user's hand. In FIG. 1, housing 4 of marker 2 has a handle grip means 88, and an inwardly tapering surrounding shell 90. FIG. 4 shows a crossectional view of the embodiment shown in FIG. 1 along line 4—4. In FIG. 2, the embodiment shows housing 4 as comprising a completely smooth cylindrical shell 92. The remaining features of the embodiments illustrated in FIGS. 1 and 2 are the same as the features fully and described and discussed above. Of course, there are many variations of configurations of housing 4, and all of these configurations are within the spirit, scope, and intent of the present invention as fully described herein. For example, housing 4 might be shaped as a triangular housing, and elliptical housing, or may even be shaped as a rectangular box shaped housing.

It will be understood that various changes in the detail, materials, steps and arrangements of parts, which have been herein described and illustrated in order to describe the nature of the invention, may be made by those skilled in the art within the principle and scope of the invention as expressed in the appended claims.

What is claimed is:

1. A marking device for applying marking liquids to a surface, which comprises:

(a) a housing having a surrounding side wall extending to a top portion and a closed bottom to provide the housing enclosing an internal volume;

(b) a first portal and a spaced apart second portal, each in fluid flow communication through the top portion of the housing;

(c) a dividing wall located internally within the housing and connected to the closed bottom end and the surrounding side wall to divide the enclosed internal volume into a first liquid reservoir in fluid flow communication with the first portal and a second liquid reservoir in fluid flow communication with the second portal;

(d) a first depositing means and a second depositing means disposed in the respective first portal and the second portal to regulate fluid flow from the first and second reservoirs through the respective first and second portals; and (e) a bumper intermediate the first and second portals and extending from the top portion generally along a longitudinal axis of the housing to a distance spaced above the first and second portals, wherein the first and second portals and the intermediate bumper are disposed along a plane intersected by the longitudinal axis of the housing, and wherein when the first and second reservoirs are provided with respective liquids, the marking device is manipulatable to position the bottom end at a higher elevation than the top portion to contact one of the first and second depositing means and the bumper with the surface to be marked and wherein the bumper prevents the other of the first and second depositing means from contacting the surface while the one depositing means is in contact therewith.

2. The marking device according to claim 1 wherein the bumper comprises an extension portion and a pressure portion, the pressure portion for contacting the surface, and the extension portion fixed to the top portion to elevate the pressure portion above the first portal and the second portal.

3. The marking device according to claim 1 wherein the first depositing means and the second depositing means have a conical shape.

4. The marking device according to claim 1 further comprising closure means removably fittable over the first portal and the second portal for closing the same.

5. The marking device according to claim 4 wherein the closure means comprises a first cap and a second cap.

6. The marking device according to claim 5 wherein the first cap and the second cap each comprise a surrounding cap wall with an open end at one end thereof and a closed end at the other end thereof, the open end of the first cap and the second cap removably fittable over the first portal and the second portal for covering the respective first and second depositing means.

7. The marking device according to claim 1 wherein the liquid is selected from the group consisting of glue, ink, paint, and florescent ink.

8. The marking device according to claim 1 wherein the surrounding side wall tapers inwardly to provide a hand grip thereon, the inwardly tapering surrounding side wall and the handgrip providing the marker with a comfortably grippable outer surface.

9. The marking device according to claim 1 wherein the surrounding side wall comprises a smooth cylindrical shell for gripping.

10. A method for applying marking liquids to a surface, comprising the steps of:

(a) providing a marking device comprising: a housing having a surrounding side wall extending to a top portion and a closed bottom to provide the housing enclosing an internal volume; a first portal and a spaced apart second portal, each in fluid flow communication through the top portion of the housing; a dividing wall located internally within the housing and connected to the closed bottom end and the surrounding side wall to divide the enclosed internal volume into a first liquid reservoir in fluid flow communication with the first portal and a second liquid reservoir in fluid flow communication with the second portal; a first depositing means and a second depositing means disposed in the respective first portal and the second portal to regulate fluid flow from the first and second reservoirs through the respective first and second portals; and a bumper intermediate the first and second portals and extending from the top portion generally along a longitudinal axis of the housing to a distance spaced above the first and second portals, wherein the first and second portals and the intermediate bumper are disposed along a plane intersected by the longitudinal axis of the housing;

(b) providing the first and second reservoirs with respective liquids; and (c) manipulating the marking device to position the bottom end at a higher elevation than the top portion to contact one of the first and second depositing means and the bumper with the surface to be marked and wherein the bumper prevents the other of the first and second depositing means from contacting the surface while the one depositing means is in contact therewith.

* * * * *